United States Patent [19]

Richter et al.

[11] Patent Number: 4,691,548

[45] Date of Patent: Sep. 8, 1987

[54] ROLLING MILL STAND FOR STRIP-SHAPED MATERIAL

[76] Inventors: Gerhard Richter, Charlotteenstrasse 5; Axel Barten, Siegener Strasse 227, both of D-5910 Kreuztal 5, Fed. Rep. of Germany

[21] Appl. No.: 769,070

[22] Filed: Aug. 26, 1985

[30] Foreign Application Priority Data

Aug. 29, 1984 [DE] Fed. Rep. of Germany ..... 3431691

[51] Int. Cl.[4] ..... B21B 37/08; B21B 31/32

[52] U.S. Cl. ..... 72/21; 72/243; 72/245

[58] Field of Search ..... 72/21, 241, 242, 243, 72/245, 8

[56] References Cited

U.S. PATENT DOCUMENTS

| | | | |
|---|---|---|---|
| 4,480,452 | 11/1984 | Schnyder | 72/21 |
| 4,577,480 | 3/1986 | Kizaki et al. | 72/8 |

FOREIGN PATENT DOCUMENTS

| | | | |
|---|---|---|---|
| 1777054 | 1/1970 | Fed. Rep. of Germany . | |
| 1527713 | 1/1970 | Fed. Rep. of Germany . | |
| 1427788 | 5/1970 | Fed. Rep. of Germany . | |
| 3212070 | 10/1982 | Fed. Rep. of Germany . | |
| 36303 | 4/1981 | Japan . | |
| 89305 | 7/1981 | Japan | 72/242 |
| 81906 | 5/1982 | Japan . | |
| 116913 | 7/1983 | Japan | 72/243 |
| 116916 | 7/1983 | Japan | 72/243 |
| 915991 | 3/1982 | U.S.S.R. | 72/241 |

OTHER PUBLICATIONS

"Blech, Rohre, Prof.", 1973, No. 2, pp. 43–46, Germany.

*Primary Examiner*—Robert L. Spruill
*Assistant Examiner*—Steve Katz
*Attorney, Agent, or Firm*—Young & Thompson

[57] ABSTRACT

The rolling mill stand, for example a four-high rolling mill stand, for strip mills, with adjusting devices acting horizontally and/or vertically on the rolls for roll nip regulation is characterized by a dual bearing for the work rolls (1, 2) in respectively two inner and outer mounting members (5, 6), which latter, for attaining the same change in shape over the strip width, are horizontally adjustable by deflecting the rolls (1, 2) in the horizontal direction by adjusting devices (7, 8), as well as by a positional control of the inner and/or outer mounting members (5, 6). With the aid of the horizontal deflection device, a position-controlled horizontal adjustment of the work rolls (1, 2) can be performed for compensating for the horizontal forces and/or for a strip thickness regulation while maintaining the horizontal bending curve (13) of the work rolls required for planeness of the strip (14).

1 Claim, 7 Drawing Figures

Figure 4:
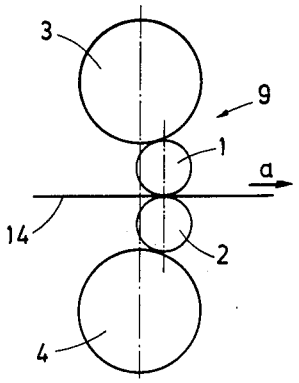

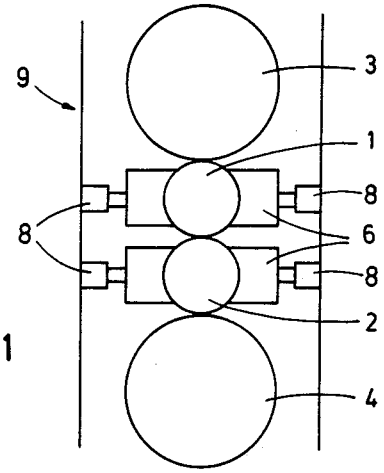
Fig. 1
Fig. 2
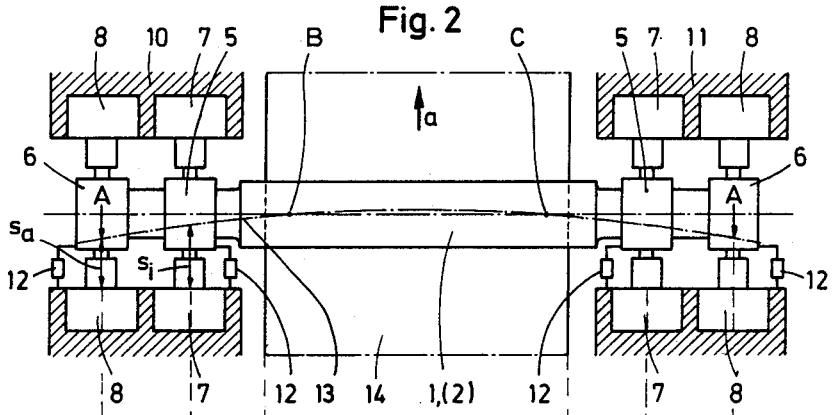
Fig. 3
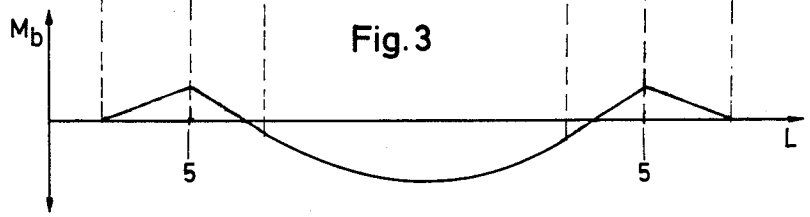

ROLLING MILL STAND FOR STRIP-SHAPED MATERIAL

The invention relates to rolling mill stands for strip-shaped material with regulating devices for roll nip control acting horizontally and/or vertically on the rolls.

Considerable horizontal forces occur in strip mills resulting from the rolling moment as well as from the reeling-off and coiling tensions; these forces cause the work rolls to be deflected in the horizontal direction against the rolling direction. When certain load limit values are exceeded, this horizontal work roll deflection leads to alterations of the roll nip profile and, in interaction with the roll nip control by vertical flexing of the work and/or backup rolls, to an unstable operation.

In the past, cluster roll stands have been developed with the aim of eliminating the disturbance in roll nip control resulting from the horizontal forces by effecting compensation of the horizontal forces acting on the work rolls.

In a rolling mill stand known from DOS No. 1,427,788, the horizontal deflection of the work rolls, caused by horizontal forces, is to be avoided by horizontal displacement of the roll neck bearings of the work rolls in the entrance or exit direction by means of hydraulic cylinders in dependence on the direction of rotation of the rolls, so that the vertical plane defined by the work roll axes is laterally offset with respect to the vertical plane of the backup roll axes. The thus-displaced work rolls operate in both directions of rotation without additional support of the roll bodies.

The requirements posed with regard to dimensional and configurational accuracy of cold-rolled thin-gage strip have increased considerably during the course of the development of the rolling technique and further processing. An ideal cold-rolled strip is not only to be of the same thickness over the length and width, but is also to lie completely planar. Planeness is also to be preserved if the strip is to be slit during further processing.

These requirements to be met by dimensional accuracy and planeness of a thin-gage strip cannot, however, be achieved. For example, if an attempt is made to cold-roll a hot-rolled strip, that is somewhat thinner along the edges than in the middle, to a completely identical thickness over the width, this necessitates a larger reduction in thickness and thus greater stretching in the strip center, leading to the formation of central waviness. In contrast, if best possible planeness is desired, one must tolerate the situation that the profile configuration of the hot-rolled strip is transferred to the cold-rolled strip.

Faults in planeness can reveal themselves after the rolling step or only during the subsequent further processing. Faults in planeness occur during rolling essentially as a consequence of different stretching over the strip width on account of nonuniform shaping of the strip over the strip width in the roll nip. During further processing, for example during slitting, faults in planeness are frequently caused by releasing of internal stresses produced during rolling.

One differentiates between planeness flaws that can be leveled by stretching and flaws that cannot be eliminated in that way. Defects wherein the strip deviates from planeness uniformly in the width direction are called removable by stretching. During this step, mutually opposed internal stresses occur on the topside and underside of the strip, these stresses being constant over the entire width. Unevennesses that can be leveled by stretching are characterized in that they are linearly restricted in one direction, i.e. in the longitudinal direction or in the transverse direction.

Deviations in planeness variable over the strip width and length are characterized by curved boundaries and cannot be stretched level by means of a simple bending process. In this case, nonuniform internal stress distributions are present in the longitudinal and transverse directions. Such planeness defects appear as central and marginal waviness in the cold-rolled strip.

During cold rolling of strips of steel, aluminum, iron, or nonferrous metals, the differences in length and/or differing stretching over the strip width are at least partially compensated by the elastic elongation on account of strip tension so that there is no unequivocal criterion, in the rolling procedure, for unduly high strip tensions, especially in the marginal zones of the strip, leading to strip fissures.

Industrial need for plane thin-gage strip products resulted in the development of numerous rolling mill stand constructions.

U.S Pat. No. 4,059,976 discloses a four-high rolling mill wherein, as in the rolling mill according to DOS No. 1,427,788, the vertical plane defined by the axes of the work rolls is offset in the horizontal direction with respect to the vertical plane defined by the axes of the back-up rolls, but wherein, for supporting the work rolls against the offset direction, supporting devices are associated with these work rolls. Such rolling mills exhibit substantial advantages over the conventional four-high rolling mill stand structure wherein the axes of the work rolls and of the backup rolls are arranged in one vertical plane; these advantages become especially apparent in the rolling of thin metal foil. With a foil thickness of, for example, 10–20 $\mu$m, it is impossible to obtain the rolling force to be exerted over the entire length of the roll nip, on account of the elasticity of the system, during occurring deflections of the rolls. However, with the aid of the supporting devices, it is possible to counteract the elastic deflections of the roll system and to correspondingly regulate the roll nip profile for the production of planar strip material.

Another rolling mill stand is known from DOS No. 1,777,054, with work rolls displaced horizontally from the vertical axial plane of the backup rolls; the bearings of these work rolls are held by claws adjustable by means of pressure medium cylinders, and the work rolls are supported in the displacement direction by one or several intermediate rolls and by supporting rolls resting on supporting bridges. In this rolling mill, for obtaining planar strip material, wegdes are provided between the bearings of the supporting rolls and the supporting bridges, which are adjustable and which jointly constitute an abutment for the bearings of the supporting rolls, this abutment extending positively or negatively in accordance with a symmetrical arc, depending on the gradient and mutual positioning.

In another rolling mill of this type, known from DOS No. 1,527,713, the supporting bridges, resting on the roll housings, are equipped with a bending means for changing the shape of the supporting surfaces for the supporting rolls acting via intermediate rolls on the work rolls.

In the conventional rolling mills of the aforedescribed type, problems arise primarily in the regulating ability of the supporting devices for the work rolls. Mechanical friction forces are produced between the structural elements of the supporting devices and the work rolls, which forces vary with the rolling, driving, and bending forces to be employed, and the traces of which are reproduced up to the highly polished rolling faces of the work rolls so that the work rolls and their supporting devices are subjected to additional wear and tear.

The reversible strip mill according to DOS No. 3,327,433 with offset work rolls and conventional vertical deflection devices for the work rolls has been developed with the objective of structural simplification, improved and simplified adjustability, and avoidance of mechanical friction between the work rolls and their horizontal supporting devices. The horizontal supporting devices for the work rolls contain hydrostatic support elements arranged in parallel to the longitudinal axis of the work rolls to be supported and comprising hydrostatic pressure pockets facing the surfaces of the work rolls to be supported and being individually regulable. The work rolls and the hydrostatic pressure pockets associated therewith are disposed in the rolling mill stand to be displaceable in parallel to the strip plane in the horizontal direction. This supporting device structure for the work rolls in the form of hydraulic supporting elements is very expensive.

Finally, a five-high strip mill with roll nip control has been known from DOS No. 3,212,070 primarily for the purpose of affecting the planeness of the rolled strip. The five-high rolling mill exhibits an upper backup roll and a lower backup roll, furthermore an upper work roll and a lower work roll, one of which has a smaller diameter and is offset in the rolling direction with respect to the vertical axial plane defined by the upper and lower backup rolls, an intermediate roll arranged between the work roll having the smaller diameter and the backup roll associated therewith, a vertical bending means for the work rolls, and a horizontal bending means for the work roll having the smaller diameter. The horizontal bending means comprises a contact roll resting against the work roll having the smaller diameter, bending forces being transmitted into this contact roll from sectional rolls, the latter being horizontally adjustable by regulable hydraulic cylinders.

The horizontal bending means of this conventional five-high rolling mill, with a number of hydraulic servo cylinders for the sectional rolls as well as the measurement and regulation of the position of each individual sectional roll are very expensive. The bending means is suitable only for work rolls having a relatively small diameter since the introduction of the bending forces takes place by way of sectional rolls which must be elastic and thus must also have smaller diameters. The rolling mill is not suited for reversible operation. On account of the great stress, the contact roll is subject to very high wear, and the great friction forces arising between the contact roll and the work roll leave, during the course of time, traces on the polished surfaces of the work rolls.

The strip material produced by means of the above-discussed strip mills does not satisfy the high quality requirements posed with respect to planeness.

The invention is based on the priority task of improving the roll nip regulation in strip mills with a view toward manufacture of strip material having maximum planeness.

Figure 6:
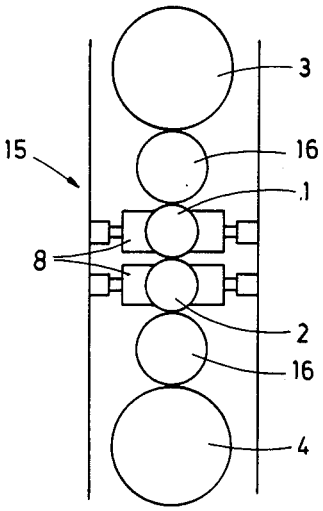
Figure 5:
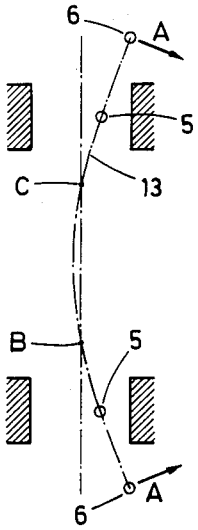
Figure 7:
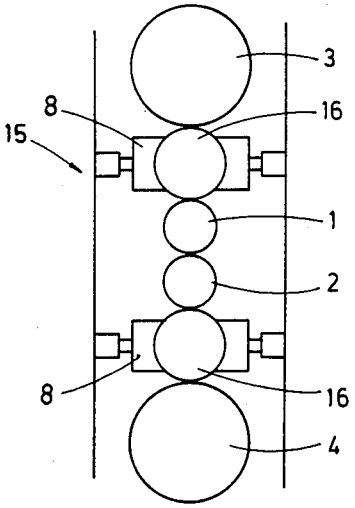

The invention, with its additional advantages, will be described in detail below with reference to schematic drawings in utilization with four-high and six-high rolling mills, identical or similar components being denoted by the same reference numerals. In the drawings:

FIG. 1 shows a lateral view of a four-high rolling mill stand wherein the axes of the backup rolls and work rolls lie in a perpendicular plane, FIG. 2 shows a top view of the upper work roll with the horizontal deflection device of this invention, pertaining to the four-high rolling mill of FIG. 1, in an enlarged representation, FIG. 3 shows a diagram of the bending moment curve over the length of the work roll, wherein, as an example, the adjusting forces acting on the deflection device are oriented in the same direction as the horizontal force acting on the roll, FIG. 4 shows a lateral view of a four-high rolling mill stand wherein the work rolls are displaced with respect to the backup rolls by means of the deflection and adjusting device, FIG. 5 shows a bending curve of the work rolls of the four-high rolling mill according to FIG. 4, required for planeness of the strip, and FIGS. 6 and 7 show respectively a lateral view of a six-high rolling mill stand, the work rolls and intermediate rolls of which are respectively regulated by the deflection and adjusting device.

The horizontal roll deflection device for roll nip regulation, installed in a four-high rolling mill according to FIGS. 1 and 2 with an upper work roll 1 and a lower work roll 2, as well as an upper backup roll 3 and a lower back-up roll 4, comprises as its main features a dual support of the work rolls 1, 2 in respectively two inner mounting members 5 and outer mounting members 6, horizontally adjustable by means of adjusting devices 7, 8, for attaining identical change in shape of the rolled strip 14 over the strip width by deflecting the rolls 1, 2 in the horizontal direction; as well as positional control of the inner and/or outer mounting members 5, 6. The adjusting devices 7, 8 for the work rolls 1, 2 are fashioned as hydrostatic piston-cylinder units. The two inner and outer mounting members 5, 6 for supporting the work rolls 1, 2 are displaceably installed in the two housings 10, 11 of the four-high rolling mill stand 9, and each mounting member 5, 6 can be adjusted by two adjusting devices 7, 8 arranged in horizontal opposition.

Position sensors 12 are associated with the inner and outer mounting members 5, 6.

The four-high rolling mill stand 9 is furthermore equipped with conventional vertical roll deflection means, not shown.

The horizontal deflection device for the work rolls 1, 2 of a four-high rolling mill according to FIGS. 1 and 2 operates basically so that the position $s_i$ of the inner mounting members 5 of the rolls 1, 2 is continuously calculated in dependence on the bending curve 13 of the rolls 1, 2 required for planeness of the strip 14, considering the horizontal force acting on the rolls 1, 2 due to the rolling moment as well as the reeling-off tension and the coiling tension, and the bending forces A acting on the outer mounting members 6 required for setting the desired bending curve 13 are likewise continuously calculated, and the hydraulic cylinders of the inner and outer adjusting devices 7, 8 are correspondingly set.

Normally, the work rolls 1, 2 are curved in the rolling direction a. Basically, there are three possibilities for work roll deflection:

1. Both work rolls are deflected at the same time and in the same direction, it being possible to effect bending in the entry and exit direction of the strip.

2. One work roll is deflected while the position of the other work roll is retained.
3. Both work rolls are bent simultaneously, but in opposite directions.

Another possible mode of operation of the horizontal roll deflecting device for the four-high rolling mill of FIGS. 1 and 2 resides in continuously calculating the positions $s_i$, $s_a$ of the inner and outer roll mounting members 5, 6 in dependence on the bending curve 13 of the work rolls 1, 2 needed for a planar strip 14, considering the horizontal force acting on the rolls 1, 2 on account of the rolling moment and the strip tensions, and correspondingly adjusting the hydraulic cylinders of the inner and outer adjusting devices 7 and 8.

FIG. 2 illustrates vividly the substantial advantage of the above-described horizontal roll deflecting device as compared with the state of the art, namely the exact regulation of the bending curve of the work rolls 1, 2 required for planeness of the strip 14, in a four-high rolling mill or of the work rolls and/or intermediate rolls in a six-high rolling mill. The bending curve 13 necessary for optimum planeness of the strip 14 can be controlled by the position-regulated inner mounting members 5 and the force-or position-regulated outer mounting members 6 of rolls 1, 2 in such a way that, for example, two intersection points B and C are obtained in the central zone of the roll bending curve 13 with the perpendicular plane defined, in the initial position of the work and backup rolls 1–4, by the roll axes; and that the central region of the work rolls 1, 2 experiences only an insignificant change in position with respect to the initial position of the rolls.

The curve of the bending moments effective on the work rolls 1, 2, according to FIG. 3, depicts a further advantage of the horizontal deflection device according to FIGS. 1 and 2. With the bending forces A, acting on the outer roll mounting members 6, being effective on the work rolls 1, 2 in the direction of the linear load, exerted by the horizontal force, the stress on the inner mounting members 5 and thus on the inner bearings of the rolls 1, 2 does increase, but the bending moment at the critical roll cross sections between the bearing seat and the roll bodies is reduced. Conversely, with an orientation of the bending forces A in opposition to the load on the roll caused by the horizontal forces, the bearing stress of the rolls is reduced, but the bending moments acting at the critical locations of the rolls are increased.

The aforedescribed horizontal roll deflection device can be utilized in reversing rolling mills, on account of the possibility of adjusting the bending curve of the roll to the pass direction.

The horizontal roll deflection device can furthermore be utilized in four-high and six-high rolling mills 9, 15 according to FIGS. 4–7, wherein the vertical plane defined by the axes of the work rolls 1, 2 is offset in the entry or exit direction by a certain measure with respect to the vertical plane defined by the axes of the backup rolls 3, 4, in order to obtain compensation of the horizontal forces as described in connection with rolling mills pertaining to the state of the art discussed hereinabove.

In the normal case, the work rolls 1, 2 are offset in the exit direction of the strip, as in the four-high rolling mill shown in FIG. 4. If, in such rolling mills, the displacement of the work rolls 1, 2 is small, then the horizontal deflection device can be used to adjust the bending curve of the work rolls 1, 2, considering the horizontal force acting on the rolls due to the rolling moment and the strip tensions, in such a way that the central section of the horizontally adjustable rolls 1, 2 is located in the plane of the rolls 3, 4 backing up the work rolls.

FIG. 6 shows the deflection and adjusting device when used with the work rolls 1 and 2, and FIG. 7 when used with the intermediate rolls 16 of a six-high rolling mill stand 15.

The horizontal deflection device can furthermore be utilized for a position-controlled horizontal adjustment of the work rolls for roll nip regulation and thus for affecting the strip thickness, namely while retaining the horizontal bending curve of the work rolls, required for strip planeness.

Finally, it is possible by means of the horizontally acting deflection and adjustment device to align the work rolls very accurately in parallel in the basic position with respect to each other and with respect to the backup rolls, and thus to compensate for inaccuracies due to manufacturing tolerances, differing running properties of the rolls in reversing rolling mills, etc.

We claim:

1. In a device for regulating the planeness and the thickness of rolled strip in a multiple-roll strip mill stand with work rolls supported on each roll side in an inner mounting member and an outer mounting member, the mounting members being mounted for movement relative to each other horizontally; the improvement comprising means (12) for continuously detecting the horizontal position ($s_i$) of the inner mounting members (5) of the rolls (1, 2), means (12) for continuously detecting the horizontal position ($s_a$) of the outer mounting members (6) of the rolls (1, 2), and means (8) for moving one of said inner and outer mounting members (5, 6) of the rolls (1, 2) in a direction and by a distance sufficient to impart to the rolls a horizontal bending line indicated by said detecting means (12) to be needed to impart uniform planeness and a desired thickness to the rolled strip.

* * * * *